United States Patent [19]

Budzich

[11] 4,199,005

[45] Apr. 22, 1980

[54] LOAD RESPONSIVE CONTROL VALVE

[76] Inventor: Tadeusz Budzich, 80 Murwood Dr., Moreland Hills, Ohio 44022

[21] Appl. No.: 818,464

[22] Filed: Jul. 25, 1977

Related U.S. Application Data

[63] Continuation-in-part of Ser. No. 716,360, Aug. 20, 1976, Pat. No. 4,107,923, and Ser. No. 750,250, Dec. 13, 1976, Pat. No. 4,089,346.

[51] Int. Cl.[2] ..... F15B 13/08

[52] U.S. Cl. ..... 137/596.13; 60/427; 91/516

[58] Field of Search ..... 60/427, 445; 91/412, 91/451, 516; 137/596.13

[56] References Cited

U.S. PATENT DOCUMENTS

| | | | |
|---|---|---|---|
| 3,455,210 | 7/1969 | Allen | 137/596.13 X |
| 3,768,372 | 10/1973 | McMillen | 91/516 |
| 3,777,773 | 12/1973 | Tolbert | 137/596.13 X |
| 3,807,447 | 4/1974 | Masuda | 137/596.13 |
| 3,815,477 | 6/1974 | Ailshie et al. | 137/596.13 X |
| 3,881,512 | 5/1975 | Wilke | 137/596.13 |
| 3,914,939 | 10/1975 | Purdy | 60/445 X |
| 3,971,216 | 7/1976 | Miller | 60/445 |
| 4,051,868 | 10/1977 | Anderson | 137/596.13 |
| 4,089,169 | 5/1978 | Miller | 137/596.13 X |

*Primary Examiner*—Gerald A. Michalsky

[57] ABSTRACT

A load responsive flow control valve for use in a system controlling a plurality of loads. The system is powered by a single fixed displacement pump equipped with a load responsive bypass valve or by a variable displacement pump equipped with a load responsive control, which during simultaneous control of multiple loads automatically maintains the pump discharge pressure at a level higher than the pressure required by the largest load being controlled. To transmit to the pump control signal of the highest system load, without creating a back flow, load sensing passages of individual valve spools contain check valves. Upstream of the check valves load sensing passages of individual spools are vented to reservoir with valve spools in neutral position, to prevent accumulation of leakage pressure affecting the pump control and to permit the use of priority type control with selected valve spools. Because of the load sensing passage venting feature the priority control is capable of fast response without large control leakage from the load sensing circuit with priority spool in neutral position.

2 Claims, 1 Drawing Figure

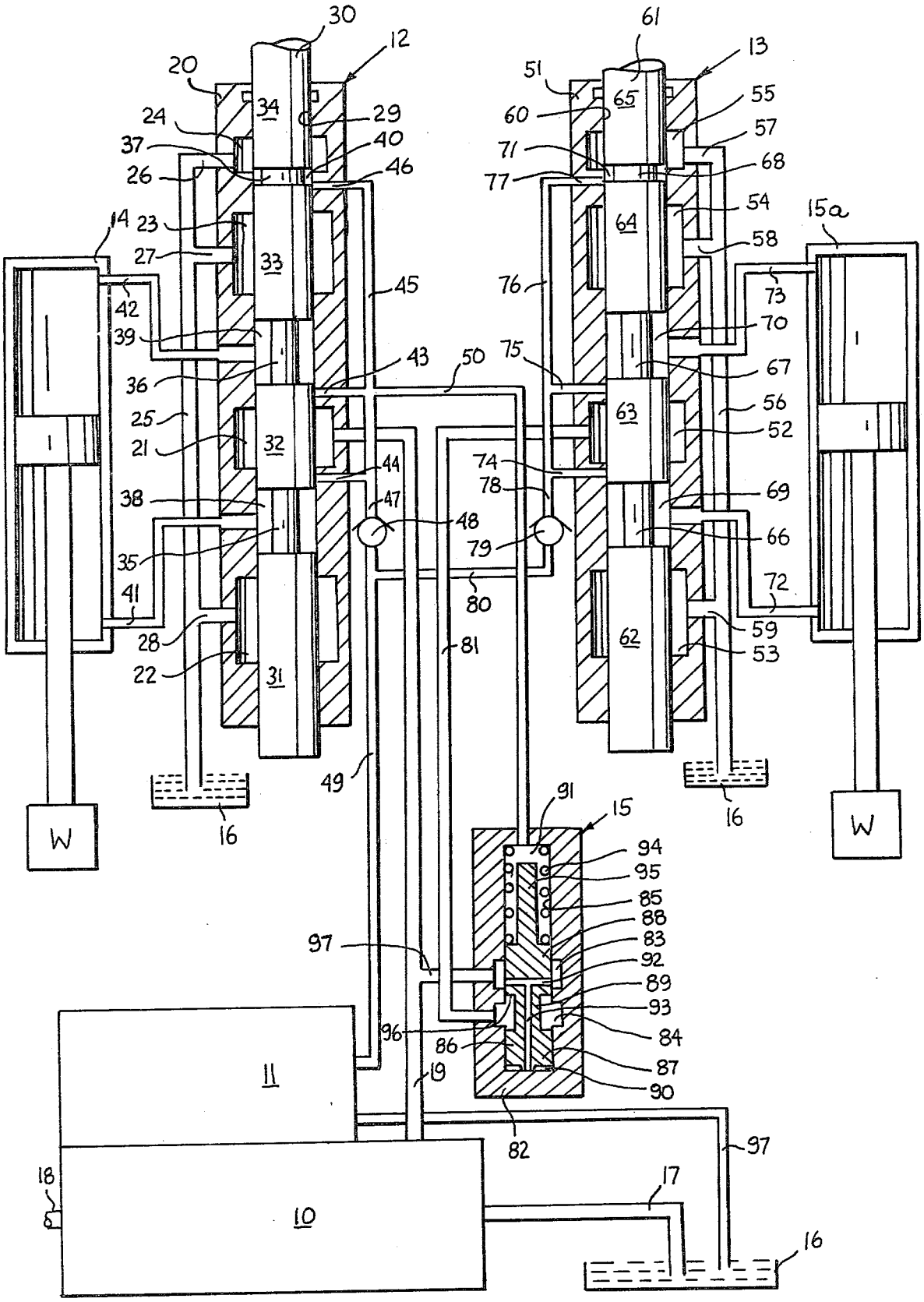
30
12
20
34
24
29
37
40
26
46
14
23
27
33
42
45
39
43
36
50
25
32
21
44
38
47
48
35
41
28
22
31
49
W
16
61
13
51
65
60
55
57
71
68
77
54
64
15a
58
76
73
70
75
67
63
56
52
74
78
69
79
66
80
72
59
81
62
53
16
W
91
15
94
95
85
88
97
83
92
89
93
96
84
86
87
19
90
82
11
97
18
17
10
16

LOAD RESPONSIVE CONTROL VALVE

This is a continuation in part of application Ser. No. 716,360 filed Aug. 20, 1976 for "Load Responsive Valve Assemblies" now U.S. Pat. No. 4,107,923, and Serial No. 750,250 filed Dec. 13, 1976 for "Load Responsive Fluid Control Valves" now U.S. Pat. No. 4,089,346.

BACKGROUND OF THE INVENTION

This invention relates generally to pressure compensated load responsive control valves of direction control type, which in control of a load, while using a control load pressure sensing passage, automatically maintain pump discharge pressure at a level higher, by a constant pressure differential, than the pressure required by the controlled load, by either bypassing excess pump flow to system reservoir, or by varying displacement of the pump. Such a control valve disclosed in U.S. Pat. No. 3,488,953 dated Jan. 13, 1970, although effective in control of a single positive load at a time, cannot simultaneously control multiple positive loads. This disadvantage is overcome by control valve disclosed in my U.S. Pat. No. 3,882,896 and my U.S. Pat. No. 3,998,134, in which individual check valves in load sensing passages permit phasing pressure signals of only the highest system load to the bypass control of a fixed displacement pump, or a load responsive control of a variable displacement pump, while isolating pressure signals from the other loads. These valves, although effective in control of multiple positive loads suffer from a number of disadvantages. Movement of the pump flow controller in one direction closes the check valves in the load sensing passages, trapping a volume of relatively incompressible fluid. Therefore movement of the controller in this direction can only be accomplished by providing leakage from the isolated space. Leakage of sufficient magnitude to provide a reasonable response of control, in turn increases the flow requirement through comparatively long, small diameter pressure sensing passages, which tends to attenuate the control signal. This disadvantage is overcome by control valve disclosed in my pending patent application Ser. No. 635,294, filed Nov. 26, 1975 entitled "Load Responsive Control Valves," which permit operation of a differential bypass valve at minimum flow levels through the passages of the load sensing circuit. However, pilot valve control does not lend itself well to the operation of a priority control valve of a type disclosed in U.S. Pat. No. 3,455,210 dated July 15, 1969. Such a valve in its operation displaces a comparatively large volume of fluid and if pressure sensing passages are used, to transmit the control signal, the valve must be capable of operation, with pressure sensing passages blocked by the valve spool in its neutral position. Under these conditions to make the priority valve operational the leakage requirements of the valve would be so great as to make its use with pressure sensing passages impractical. With all of the spools of load responsive valve in neutral position, leakage from the cylinder cores, subjected to load pressure, to the pressure sensing passages of the load sensing circuit takes place. Especially in cases, where the valve spool to bore clearances is large, this leakage can be comparatively large at high load pressures and can adversely affect the valve controllers, building up a pressure in the load sensing circuit.

SUMMARY OF THE INVENTION

It is therefore a principal object of this invention to vent the load sensing passages of the load sensing circuit of each valve spool, with valve spool in neutral position, to prevent build-up of pressure in load sensing passages of individual spools due to leakage from pressurized cylinder cores, while permitting transmittal of load pressure signals from valve spools operating loads to the control regulating flow of system pump through a check valve logic circuit. It is another object of this invention to provide a load responsive valve, equipped with load sensing circuit composed of load sensing passages leading from individual spools integrated by check valve system to transmit highest load signal pressure to the control regulating flow of system pump, which permits free operation of priority type control with valve spool controlling priority load in neutral position with its load sensing passages blocked.

It is a further object of this invention to provide a load responsive valve, equipped with load sensing circuit transmitting a control signal to the control regulating flow of system pump, which permits fast response of priority type control valve, without the use of excessive leakage from the load sensing circuit.

Briefly the foregoing and other additional objects and advantages of this invention are accomplished by providing a load sensing circuit of a load responsive valve using multiple spools, multiple pressure sensing passages and check valves, which with leakage from the load sensing circuit reduced to minimum permits the use of fast responding priority type control.

Similarly due to the venting of load sensing passages of individual spools in neutral position, operation of priority type control is improved, while at the same time pressure buildup in load sensing circuit due to leakage from pressurized cylinder cores is prevented.

Additional objects of the invention will become apparent from the following detailed description of the preferred embodiment thereof, which is schematically illustrated by a single FIGURE of the accompanying drawing.

DESCRIPTION OF THE PREFERRED EMBODIMENT

Referring now to the drawing the hydraulic system shown therein comprises a fluid pump 10 equipped with a flow control 11 which regulates delivery of the pump 10 into a load responsive circuit composed of direction control valve assemblies generally designated as 12 and 13, controlling actuators 14 and 15*a* which drive loads W and a priority control valve, generally designated as 15. The pump 10 may be of fixed or variable displacement type. With the pump 10 being of fixed displacement type the flow control 11, in a well known manner, regulates delivery from the pump 10 to load responsive circuit by bypassing part of the pump flow to the system reservoir 16. With the pump 10 being of variable displacement type the flow control 11, in a well known manner, regulates delivery from the pump 10 to the load responsive circuit by changing the pump displacement. Although in the drawing for purposes of demonstration of the principle of the invention, direction control valve assemblies 12 and 13 are shown separated and the flow control 11 is shown mounted on the pump 10, in actual application valve assemblies 12 and 13 and the flow control 11 would be most likely contained in a single valve housing or would be bolted together as sections of a sectional valve assembly. As shown in the drawing, fixed or variable displacement pump 10 has inlet line 17 which supplies fluid to pump from the reservoir 16, and the pump is driven through a shaft 18 by a prime mover, not shown. The pump 10 has outlet line 19 through which pressurized fluid is supplied to direction control valve assemblies 12 and 13.

The direction control valve 12 has a valve housing 20 which defines an inlet chamber 21 and also defines exhaust chambers 22 and 23 and a low pressure chamber 24 which are connected to each other and to the reservoir 16 by duct 25 and lines 26, 27 and 28. The valve housing 20 axially guides in a valve bore 29 a valve spool 30 which with lands 31, 32, 33 and 34 and stems 35, 36 and 37 defines load chambers 38 and 39 and an unloading chamber 40. Load chambers 38 and 39 are connected through lines 41 and 42 to the actuator 14. Load sensing ports 43 and 44 are connected through line 45 with an unloading port 46 and through line 47, a check valve 48 and line 49 to the flow control 11. Load sensing ports 43 and 44 are also connected through line 50 with the priority control valve 15.

Similarly, the direction control valve 13 has a valve housing 51 which defines an inlet chamber 52 and also defines exhaust chambers 53 and 54 and a low pressure chamber 55 which are connected to each other and to the reservoir 16 by duct 56 and lines 57, 58 and 59. The valve housing 51 axially guides in a valve bore 60 a valve spool 61 which by lands 62, 63, 64 and 65 and stems 66, 67 and 68 defines load chambers 69 and 70 and an unloading chamber 71. Load chambers 69 and 70 are connected through lines 72 and 73 to the actuator 15*a*. Load sensing ports 74 and 75 are connected through line 76 with an unloading port 77 and through line 78, a check valve 79 and line 80 to line 49 leading to the flow control 11. The inlet chamber 52 of direction control valve 13 is connected by line 81 with the priority control valve 15. The priority control valve 15 has a valve housing 82 which defines a supply chamber 83 and an outlet chamber 84. The valve housing 82 axially guides in a valve bore 85 a valve spool 86, which, by lands 87 and 88 connected by stem 89, defines a reaction chamber 90 and a signal chamber 91. The supply chamber 83 is connected by passages 92 and 93 to the reaction chamber 90. A control spring 94 in the signal chamber 91 biases the valve spool 86 equipped with stop 95 towards position at which throttling edge 96 closes communication between the supply chamber 83 and the outlet chamber 84. The supply chamber 83 is connected by line 97 to outlet line 19. The outlet chamber 84 is connected through line 81 with the inlet chamber 52 of direction control valve 13 and the signal chamber 91 is connected through line 50 with load sensing ports 43 and 44 and the unloading port 46.

All of the basic system components, as shown in the drawing, are at rest in unloaded or unactuated position with the pump 10 not working. Application of loads W to actuators 14 and 15*a* in a downward direction will transmit load pressure through lines 41 and 72 to load chambers 38 and 69. In a well known manner leakage flow through the bore spool clearance will take place from the load chamber 38 to the load sensing port 44 and from the load chamber 69 to the load sensing port 74. Load sensing ports 44 and 74 are connected through lines 45 and 76 respectively with unloading ports 46 and 77 and also through lines 47 and 78, check valves 48 and 79 and line 80 with each other. In the neutral position of valve spools 30 and 61, as shown in the drawing, unloading chambers 40 and 71 connect unloading ports 46 and 77 with low pressure chambers 24 and 55 which are in direct communication through line 26 and duct 25 and through line 57 and duct 56 respectively with the reservoir 16. Therefore in neutral position of spools 30 and 61 all of the leakage from direction control valves load chambers 38, 39, 69 and 70 into load sensing ports 43, 44, 74 and 75 will be conducted through unloading ports 46 and 77 to the system reservoir 16. Line 50 will also effectively connect the signal chamber 91 of priority control valve 15 to the system reservoir 16. Also line 49 connecting load sensing ports 43, 44, 74 and 75 with the flow control 11 will be subjected to reservoir pressure.

With the pump 10 started up, the flow control valve 11, in a well known manner, either by bypassing excess pump flow through line 97 to the system reservoir 16 in the case of fixed displacement pump, or by varying displacement changing mechanism in the case of variable displacement pump, will maintain a constant pressure differential between the pressure in outlet line 19 and the signal pressure in line 49. Since with valve spools 30 and 61 in neutral position pressure signal in line 49 is maintained at atmospheric pressure, to maintain a constant pressure differential the flow control 11 will maintain outlet line 19 at a constant minimum standby pressure level. This minimum standby pressure level will be transmitted through line 97 into the supply chamber 83 and through passages 93 and 92 to the reaction chamber 90, where it will react on the cross-sectional area of valve spool 86 generating a force. Since the signal chamber 91 is connected to the reservoir 16 and therefore subjected to reservoir pressure, the force generated by pressure in the reaction chamber 90 will move the valve spool 86 upwardly against the biasing force of control spring 94, throttling edge 96 connecting the outlet chamber 84 with the supply chamber 83 and therefore connecting outlet line 19 with line 81 and the inlet chamber 52. Therefore, under these conditions inlet chambers 21 and 52 will be subjected to the minimum pump standby pressure.

Assume that while constant minimum pressure condition is maintained in outlet line 19, the valve spool 30 is initially displaced upwards, displacement of land 33 cutting off the unloading port 46 from the low pressure chamber 24 and therefore from the system reservoir 16. Further upward movement of the valve spool 30, through displacement of land 32, will connect the load chamber 38 with the load sensing port 44. The load pressure transmitted from the actuator 14, in a well known manner, will open the check valve 48, close the check valve 79 and reacting through line 49 on the flow control 11 increase the pressure in outlet line 19, to maintain a constant pressure differential between pump pressure in outlet line 19 and load pressure in line 49. Increased load pressure in the load sensing port 44 will also be transmitted through line 50 to the signal chamber 91. Since the pump pressure in the supply chamber 83 and therefore in the reaction chamber 90 will be also proportionally increased, the pressure differential acting on the cross-sectional area of valve spool 86, against the biasing force of the control spring 94, will remain the same, maintaining free flow passage between the supply chamber 83 and the outlet chamber 84.

Further upward movement of valve spool 30 will connect the load chamber 38 with the inlet chamber 21 while at the same time connecting the load chamber 39 with the exhaust chamber 23. Since a constant pressure differential is maintained by the flow control 11 between the inlet chamber 21 and the load chamber 38, in a well known manner, fluid flow from the inlet chamber 21 to the load chamber 38 and the actuator 14 will be proportional to the area of the opening between the inlet chamber 21 and the load chamber 38 and therefore will be proportional to the displacement of the valve spool 30, irrespective of the magnitude or variation in the load pressure in the actuator 14. Movement from the neutral position of spool 30 downwards will first cut off the unloading chamber 40 from the low pressure chamber 24 thus effectively blocking the unloading port 46 from the reservoir 16. Further downward movement of valve spool 30 will connect the load chamber 39 with the load sensing port 43. If load W is acting in an upward direction and if the load chamber 39 is pressurized, an identical sequence of control functions as already described will result. If load W is acting downwards, a zero pressure signal will be transmitted through the load sensing port 43 and the pump 10 will remain at its minimum standby pressure level. Further movement of the valve spool 30 downwards will connect the load chamber 39 with the inlet chamber 21 and the load chamber 38 with the exhaust chamber 22. In a well known manner, flow from the pressurized load chamber 38 into the exhaust chamber 22 will take place, while fluid at pump standby pressure will be delivered from the inlet chamber 21 to the load chamber 39 and the actuator 14.

Assume that during equilibrium condition with pump at standby pressure level the valve spool 61 is initially displaced upwards, displacement of the land 64 cutting off the unloading port 77 from the low pressure chamber 55 and therefore from the system reservoir 16. Further upward movement of the valve 61 through displacement of the land 63 will connect the load chamber 69 with the pressure sensing port 74. The load pressure transmitted from the actuator 15*a*, in a well known manner, will open the check valve 79, close the check valve 48 and reacting through line 49 on the flow control 11 increase the pressure in outlet line 19, to maintain a constant pressure differential between pump pressure in outlet line 19 and load pressure in line 49. Increased pump pressure will also be transmitted through line 97, the supply chamber 83, passages 92 and 93 to the reaction chamber 90. Since the signal chamber 91 is subjected to reservoir pressure and the valve spool 86 is already in its upward position with stop 95 against the valve housing 82, the valve spool 86 will not move but will be subjected to a higher pressure differential. Further movement of the valve spool 61 upwards will connect the inlet chamber 52 with the load chamber 69 simultaneously connecting the load chamber 70 with the exhaust chamber 54. In a manner as previously described the flow from the pump 10 to the actuator 15*a* will be proportional to displacement of valve spool 61 and independent of load pressure.

Assume that during equilibrium condition with pump at standby pressure level both valve spools 30 and 61 are initially displaced upwards, displacement of lands 33 and 64 cutting off unloading ports 46 and 77 from low pressure chambers 24 and 55 and therefore from the system reservoir 16. Further upward movement of valve spools 30 and 61, through displacement of lands 32 and 63 will connect the load chamber 38 with the load sensing port 44 and the load chamber 69 with the load sensing port 74. In a well known manner only the higher of the two load pressure signals will be transmitted to the flow control 11. Assume that the actuator 14 carries a larger load than the actuator 15*a*. Load pressure from the load sensing port 44 will open the check valve 48, close the check valve 79 and react through line 49 on the flow control 11 to raise the pressure of the pump 10 to a level higher by a constant pressure differential than the load pressure. In a manner as previously described the priority control valve 15 will remain open connecting the supply chamber 84 with the outlet chamber 83. Therefore inlet chambers 21 and 52 of direction control valves 12 and 13 will be connected to full pump pressure. Since the flow control 11 maintains a constant pressure differential between pressure of pump 10 and load pressure in the load chamber 38, flow from the pump 10 to the actuator 14, will be, in a manner as previously described, proportional to the displacement of valve spool 30, irrespective of the variation in load pressure. However, pressure differential between the pump 10 and the load chamber 69 is not maintained constant and is higher than the constant controlled level. Therefore flow from the inlet chamber 52 to the load chamber 69 and therefore to the actuator 15*a* will not be proportional to the displacement of valve spool 61 and will vary with variation in load W.

Assume that when simultaneously controlling actuators 14 and 15*a* the combined flow demand of both actuators will exceed maximum pump capacity. The pressure in outlet line 19 will begin to drop while load pressure signal from the load sensing port 44 will remain at the same level, thus reducing the pressure differential below its controlled level. Since the valve spool 89 of priority control valve 15 responds to pressure differential between the pump and load pressures, the valve spool 89 will move downwards, throttling edge 96 throttling fluid flow to the actuator 15*a* and thus providing priority flow to the actuator 14. With flow demand of actuator 14 approaching the maximum flow capacity of the pump, throttling edge 96 will completely cut off fluid flow to the actuator 15*a*, full flow of the pump 10 being diverted at a controlled pressure level to the actuator 14. Therefore as long as maximum pump capacity is not exceeded the priority control valve 15 will remain fully open under all operating conditions and will not influence the performance of the load responsive valve. However once the pump capacity is exceeded the priority control valve 15 will direct the pump flow to the priority load responsive direction control valve by reducing flow supplied to other valves, the priority load responsive direction control valve still retaining the proportional flow control feature. This feature is independent of the magnitude of the priority load in respect to other controlled system loads. Even when the priority load is lower than other system loads and the pump flow capacity is exceeded, pump pressure will be allowed to drop to a level at which a constant pressure differential will be maintained by the priority valve 15 between pump pressure and priority load pressure.

Although the preferred embodiments of this invention have been shown and described in detail it is recognized that the invention is not limited to the precise form and structure shown and various modifications and rearrangements as will readily occur to those skilled in the art upon full comprehension of this invention may be resorted to without departing from the scope of the invention as defined in the claims.

What is claimed is:

1. A valve assembly having a first housing and other housings forming a multiple housing assembly each having an inlet chamber, a load chamber subjected to load pressure and an exhaust chamber connected to system reservoir, valve bore means in each housing interconnecting said chambers and axially guiding a valve spool means movable from a neutral position to at least one actuating position, load sensing port means in the region of each valve bore means between said inlet chamber and said load chamber, sensing port unloading means in the region of each valve bore means adjacent to said exhaust chamber operable to selectively connect for fluid flow said load sensing port means and said exhaust chamber, control pressure passage means, check valve means interposed between said control pressure passage means and each of said load sensing port means and said sensing port unloading means to permit fluid flow from said load sensing port means to said control pressure passage means and to block reverse flow from said control pressure passage means, a pump means operable to supply fluid to said inlet chambers through discharge flow passage means, flow control means responsive to pressure signal in said control pressure passage means and operable to vary fluid flow delivered from said pump means to said inlet chambers to maintain a constant pressure differential between fluid pressure delivered by said pump and said load chamber subjected to highest load pressure, when said inlet chambers and said load chambers are interconnected by said valve spool means, venting means of said sensing port unloading means operable to connect said load sensing port means to said system reservoir when said first valve means is in a neutral position, and priority flow control means in said discharge flow passage means interconnecting said pump means and said inlet chambers of said other housings, said priority flow control means having fluid throttling means between said pump means and said other housings, said fluid throttling means having first means responsive to pressure in said load sensing port means of said first housing, second means responsive to pressure in said discharge flow passage means, and means to deactivate said fluid throttling means of said priority flow control means having unloading passage means operable to connect said fluid throttling means to said venting means upstream of said check valve means when said valve spool of said first housing is in neutral position, said priority flow control means operable to throttle fluid flow from said pump means to said other housings when pressure differential between discharge pressure of said pump means and pressure in said load sensing port means of said first housing drops below a certain predetermined value, said priority flow control means having flow connecting means to connect said pump means with said inlet chambers of said other housings when said valve spool means of said first housing is in neutral position and when said sensing port unloading means connects said load sensing port means of said first housing with said exhaust chamber.

2. A valve assembly having a first housing and other housings forming a multiple housing assembly each having an inlet chamber, a load chamber subjected to load pressure, and an exhaust chamber connected to system reservoir, valve bore means in each housing interconnecting said chambers and axially guiding a valve spool means movable from a neutral position to at least one actuating position, load sensing port means selectively communicable with said load chamber by said valve spool means, load sensing port unloading means for selectively interconnecting said load sensing port means with said exhaust chamber by said valve spool means in neutral position of said valve spool means, control pressure passage means interconnecting said load sensing port means of all of said housings, check valve means interposed between said control pressure passage means and each of said load sensing port means and said load sensing port unloading means to permit fluid flow from said load sensing port means to said control pressure passage means and to block reverse flow from said control pressure passage means, pump means operable to supply fluid to said inlet chambers through discharge flow passage means, flow control means responsive to pressure signal in said control pressure passage means and operable to vary fluid flow delivered from said pump means to said inlet chambers to maintain a constant pressure differential between fluid pressure delivered by said pump and said load chamber subjected to highest load pressure when said inlet chambers and said load chambers are interconnected by said valve spool means, and priority flow control means in said discharge flow passage means interconnecting said pump means and said inlet chambers of said other housings, said priority flow control means having fluid throttling means between said pump means and said other housings, said fluid throttling means having connecting means, first means responsive to pressure in said load sensing port means and said load sensing port unloading means of said first housing, said first means having unloading passage means operable to connect said fluid throttling means to said load sensing port unloading means of said first housing upstream of said check valve means, and second means responsive to pressure in said discharge flow passage means, whereby said priority flow control means will connect by said connecting means said pump means with said inlet chambers of said other valve means when said valve spool means of said first housing is in neutral position.

* * * * *